US009573731B2

(12) United States Patent
Ho

(10) Patent No.: US 9,573,731 B2
(45) Date of Patent: Feb. 21, 2017

(54) ADAPTABLE TUBE CONNECTOR

(71) Applicant: HON HAI PRECISION INDUSTRY CO., LTD., New Taipei (TW)

(72) Inventor: Tung-Fa Ho, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 117 days.

(21) Appl. No.: 14/699,769

(22) Filed: Apr. 29, 2015

(65) Prior Publication Data

US 2016/0186900 A1 Jun. 30, 2016

(30) Foreign Application Priority Data

Dec. 24, 2014 (CN) ..... 2014 1 0813401

(51) Int. Cl.
*B65D 5/72* (2006.01)
*B65D 35/38* (2006.01)

(52) U.S. Cl.
CPC ..... *B65D 35/38* (2013.01)

(58) Field of Classification Search
CPC ..... B65D 35/38; B65D 35/36
USPC ..... 222/566, 567, 568, 575
See application file for complete search history.

(56) References Cited

U.S. PATENT DOCUMENTS 358,811 A * 3/1887 Hallowell ..... B65D 47/40 222/109
1,279,695 A * 9/1918 Hollis ..... B65D 47/263 220/296
1,750,205 A * 3/1930 Willumsen ..... B60K 15/06 222/514
2,038,057 A * 4/1936 Peters ..... B65D 35/38 222/498
2,103,111 A * 12/1937 Ekdahl ..... B65D 35/38 222/478
D136,098 S * 8/1943 Ekdahl ..... 222/575
3,570,726 A * 3/1971 Pomodoro ..... B65D 47/12 222/546
5,104,013 A * 4/1992 Hawley ..... B65D 35/38 222/566
6,688,501 B2 * 2/2004 DeGroot ..... B65D 47/0804 222/556
7,051,905 B2 * 5/2006 Hierzer ..... B65D 47/0809 215/235
7,213,727 B2 * 5/2007 Kokubo ..... B65D 47/0838 215/320
8,540,100 B1 9/2013 Lee
2003/0209575 A1 * 11/2003 Bremner ..... B65D 35/38 222/566
2008/0089967 A1 * 4/2008 Bourque ..... A23G 3/0021 425/183
2008/0110929 A1 * 5/2008 Stanley Traasdahl . B65D 47/06 222/109

FOREIGN PATENT DOCUMENTS

CN 203143246 U 8/2013

* cited by examiner

*Primary Examiner* — Patrick M Buechner
(74) *Attorney, Agent, or Firm* — Zhigang Ma

(57) ABSTRACT

An adaptable tube connector configured to be coupled with a flexible tube includes a connecting tube with an inner surface and an extrusion tube. The connecting tube is made of flexible material, and defines a plurality of internal screw threads. Each screw thread extends around a periphery of the connecting tube. The extrusion tube is coupled to an end of the connecting tube, communicates with the connecting tube, and defines a flat outlet opening on the end away from the connecting tube.

8 Claims, 7 Drawing Sheets

ADAPTABLE TUBE CONNECTOR

FIELD

The subject matter herein generally relates to adaptable tube connectors, and in particular an adaptable connector configured for connecting a flexible tube with a flat opening.

BACKGROUND

Toothpaste for consumer use has long been sold in flexible tubes requiring the user to squeeze part of the flexible tube to extract the paste from a spout at one end of the flexible tube. The spout is usually cylindrical.

BRIEF DESCRIPTION OF THE DRAWINGS

Implementations of the present technology will now be described, by way of example only, with reference to the attached figures.

DETAILED DESCRIPTION

Figure 1:
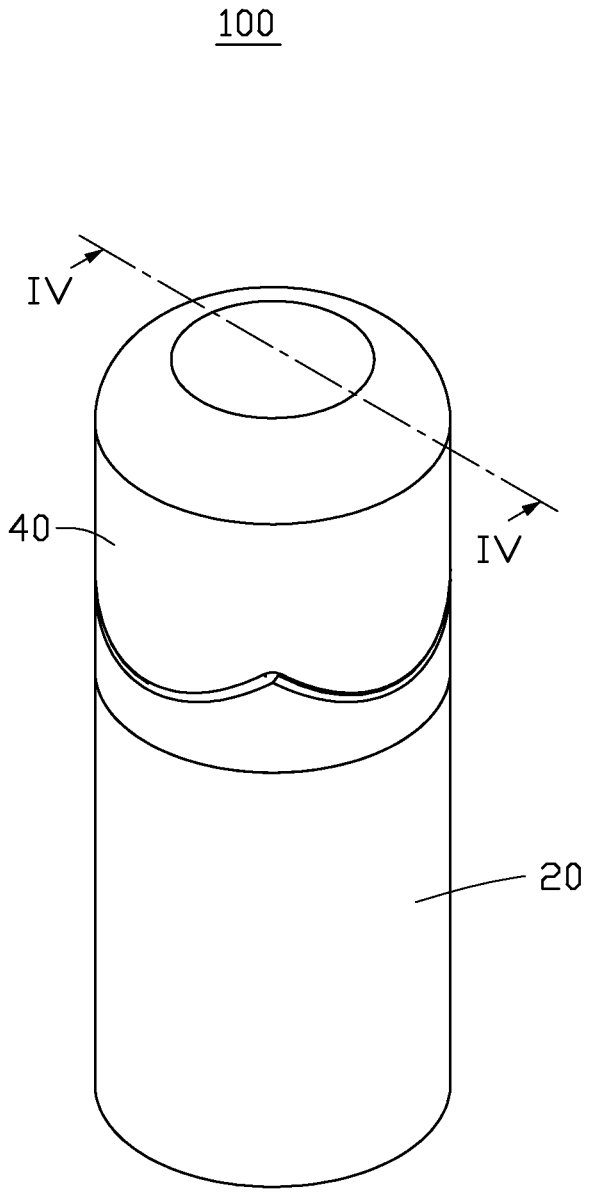
FIG. 1 is an isometric view of a first embodiment of an adaptable tube connector.
Figure 2:
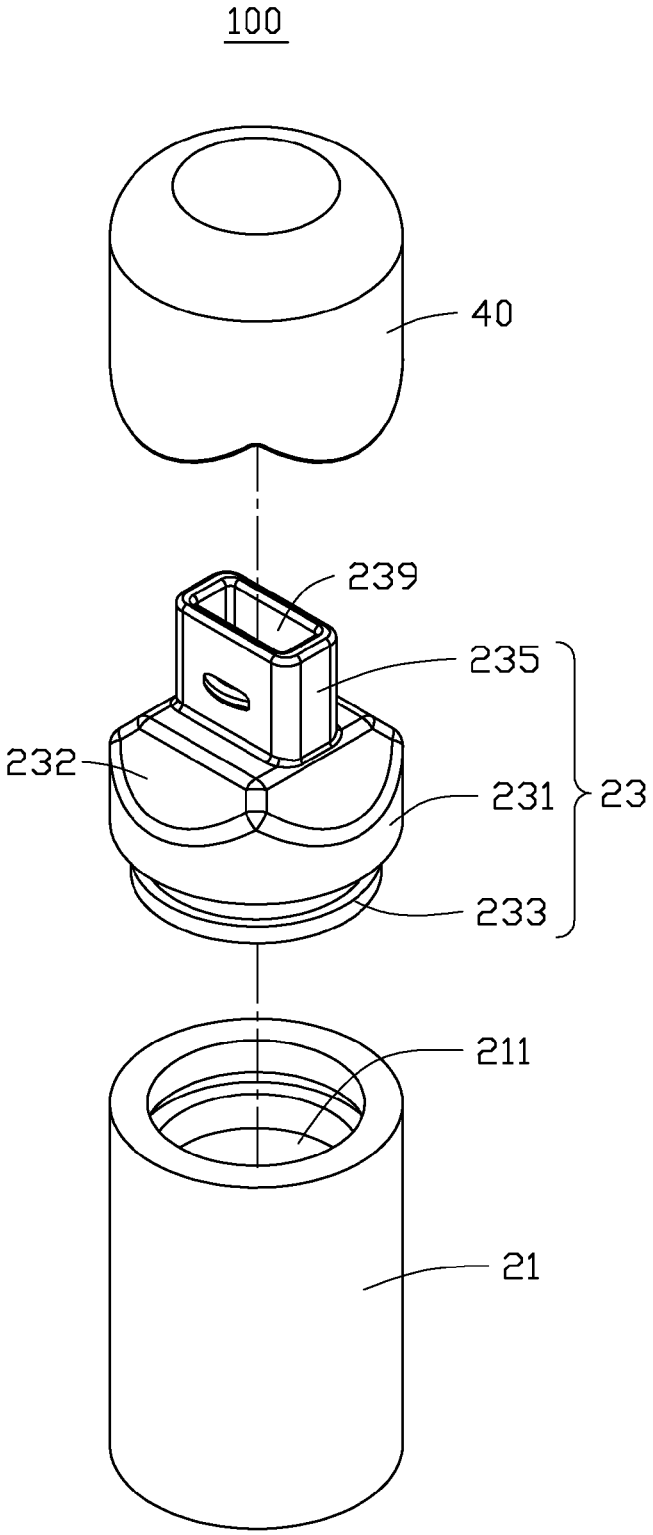
FIG. 2 is an exploded, isometric view of the adaptable tube connector of FIG. 1.
Figure 3:
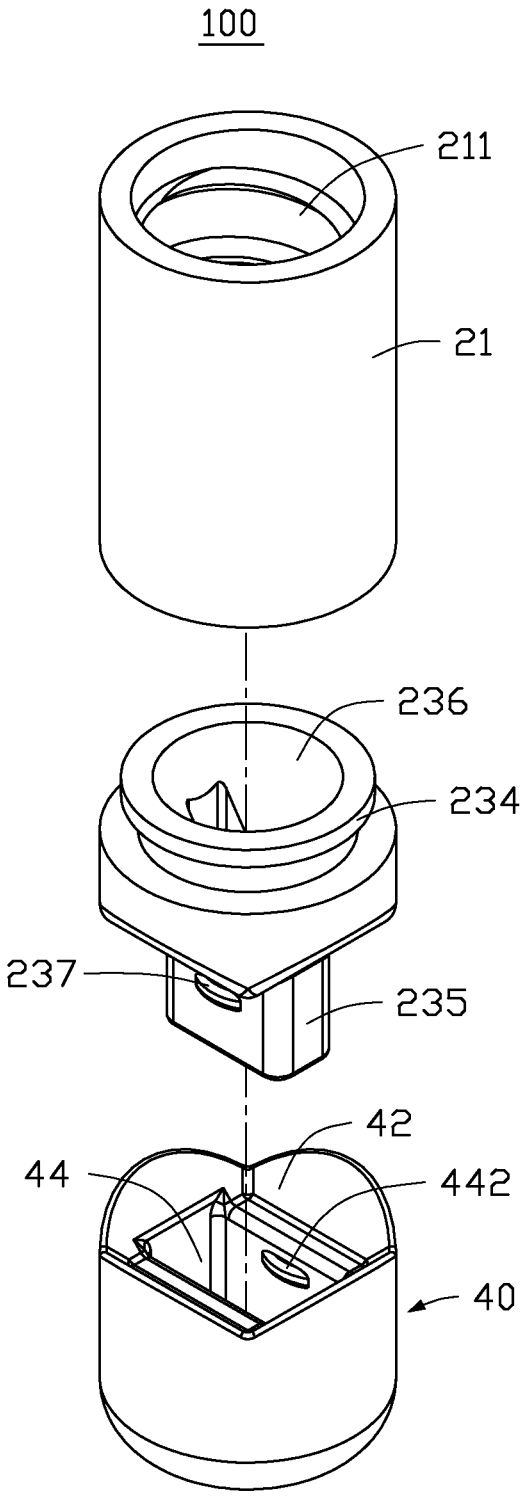
FIG. 3 is similar to FIG. 2, but viewed from another angle.
Figure 4:
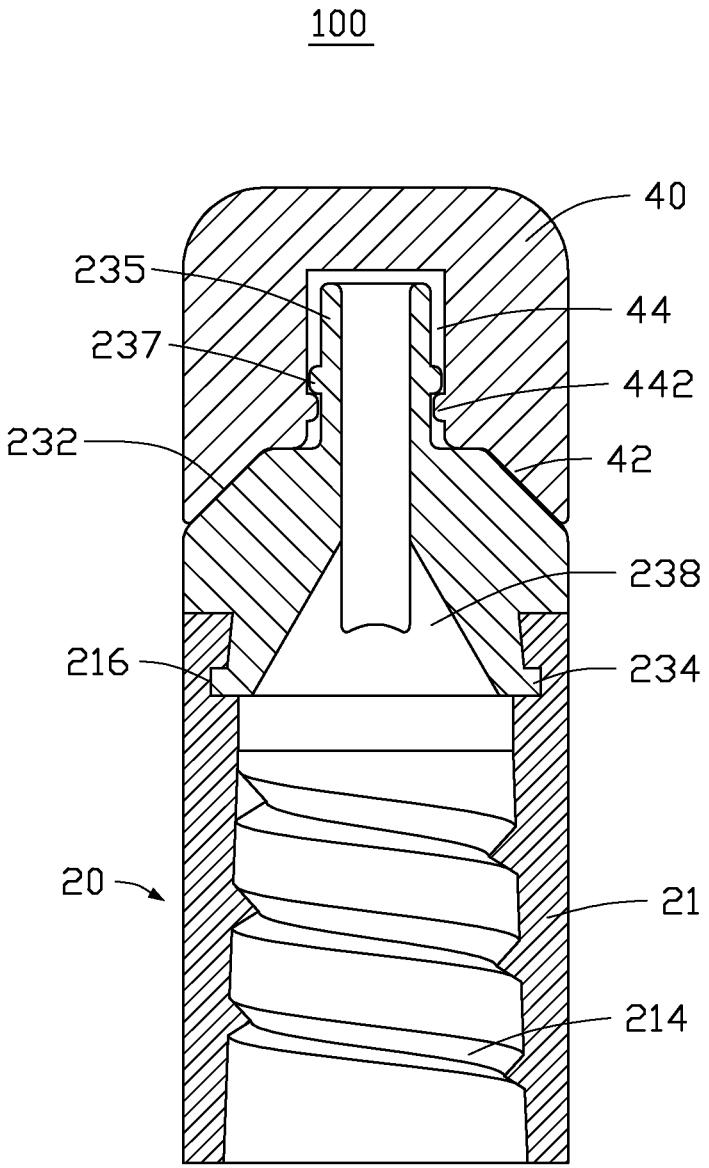
FIG. 4 is a cross-sectional view of the adaptable tube connector of FIG. 1, taken along line IV-IV of FIG. 1.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

An adaptable tube connector configured to be coupled with a flexible tube can include a connecting tube with an inner surface and an extrusion tube. The connecting tube can be composed of flexible material, and can define a plurality of radially-cut screw threads on the inner surface of the connecting tube. Each screw thread can extend from a periphery of the connecting tube. The extrusion tube can have a first end and a second end. The first end can be coupled to an end of the connecting tube, can communicate with the connecting tube, and can have a flat outlet opening on the end thereof away from the connecting tube.

FIGS. 1 to 4 illustrate a first embodiment of an adaptable tube connector 100 for connecting to a flexible tube (not shown), such as a toothpaste tube, or to another plastic tube. The adaptable tube connector 100 can include a dispensing body 20 and a cap 40. The cap 40 can cover an end of the dispensing body 20.

The dispensing body 20 can be hollow, and can include a connecting tube 21, and an extrusion tube 23 coupled to end of the connecting tube 21. The connecting tube 21 can be substantially cylindrical and made of flexible material, such as thermoplastic urethane. The connecting tube 21 can define an axial connecting hole 211 with an inner surface (not shown). The axial connecting hole 211 can pass through opposite ends of the connecting tube 21. The connecting tube 21 can define a number of radially-cut screw threads 214 and an annular latching groove 216 on the inner surface of the connecting hole 211. The screw threads 214 can be configured to be screwed onto the dispensing port of the flexible tube. Each screw thread 214 can extend around a periphery of the inner surface of the connecting hole 211. The latching groove 216 can be located adjacent to an end of the connecting tube 21, and can extend around the periphery of the inner surface of the connecting hole 211.

The extrusion tube 23 can have a first end and a second end, the first end can be received in the connecting hole 211. The extrusion tube 23 can be composed of acrylonitrile butadiene styrene (ABS). The extrusion tube 23 can include a tube body 231, and a connecting portion 233 and a dispensing portion 235 respectively coupled to opposite ends of the tube body 231. The extrusion tube 23 can define a through hole 238 passing through the connecting portion 233, the tube body 231, and the dispensing portion 235, from a first end toward a second end of the extrusion tube 23. The through hole 238 can have an inlet opening 236, and an outlet opening 239 opposite to the inlet opening 236.

The tube body 231 can be substantially cylindrical, and can have a size matching that of the connecting tube 21. The tube body 231 can define a tapered flange 232 on an end of the periphery of the tube body 231 adjacent to the dispensing portion 235. The connecting portion 233 can be coupled to the end of the tube body 231 away from the tapered flange 232. The connecting portion 233 can be substantially cylindrical, to be securely received in the connecting hole 211. A protrusion 234 can protrude from an end of the connecting portion 233 away from the tube body 231, extend around the periphery of the connecting portion 233, to be received in the latching groove 216. The inlet opening 236 can be located on the end of the connecting portion 233 away from the tube body 231, and can have a size matching that of the connecting hole 211. The dispensing portion 235 can be substantially flat and hollow. The outlet opening 239 can be located on the end of the dispensing portion 235 away from the tube body 231, and can be substantially flat. The size of the outlet opening 239 can be made as needed. In at least one embodiment, the flat outlet opening 239 can be a rectangular opening with a length of 12 millimeters and a width of 5 millimeters. Two first latching blocks 237 can respectively protrude from opposite outer surfaces of the dispensing portion 235. The connecting tube 21 can be integrated with the extrusion tube 23 via a bi-color molding process. In at least one embodiment, the connecting tube 21 and the extrusion tube 23 can be independently molded, and then assembled together.

The cap 40 can be substantially cylindrical, and can define, in this order, a latching groove 42 and a receiving groove 44 from a first end toward a second end of the cap 40. The shape of the latching groove 42 can correspond to that of the tapered flange 232, thus the tapered flange 232 can be received in the latching groove 42. The receiving groove 44 can communicate with the latching groove 42, be substantially flat, and can be configured to receive and seal the dispensing portion 235 of the extrusion tube 23. Two second latching blocks 442 to engage with the two first latching blocks 237 can protrude from the inner surface of the receiving groove 44.

When in use, the connecting tube 21 can be coupled to the flexible tube, the toothpaste received in the flexible tube can be squeezed out of the adaptable tube connector 100 via the connecting hole 211, the through hole 238, and the flat outlet opening 239.

Figure 5:
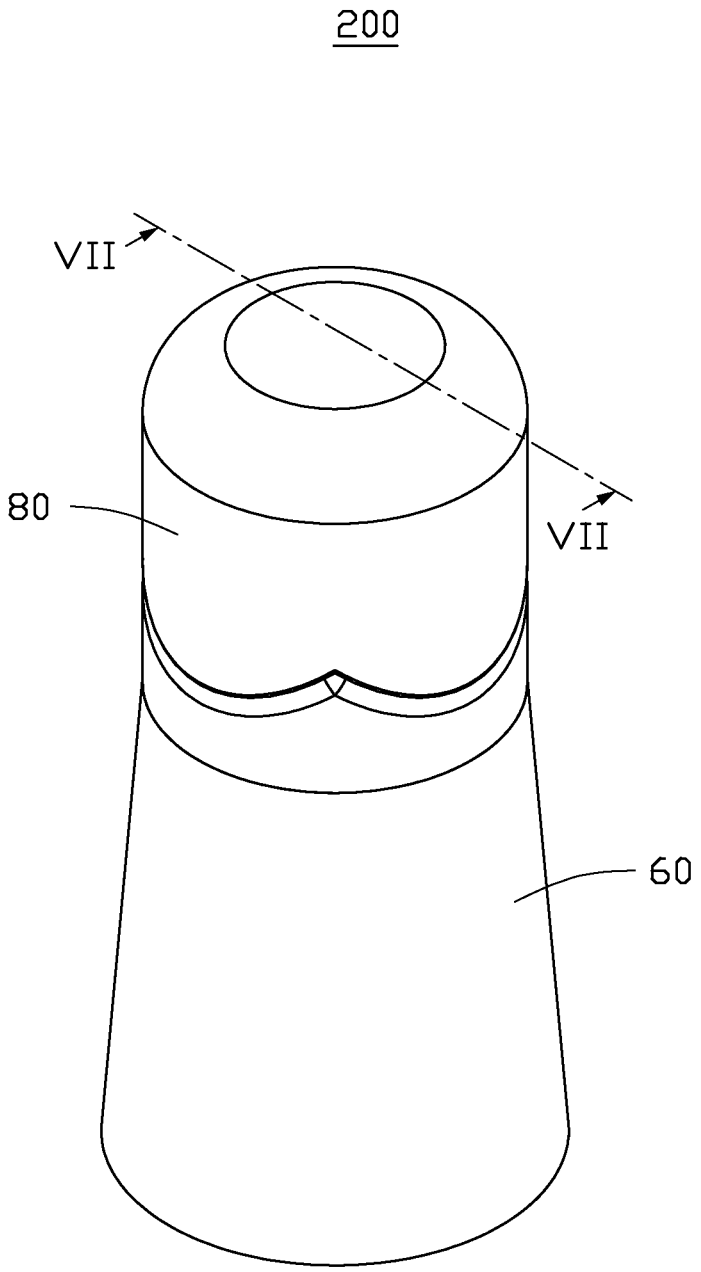
FIG. 5 is an isometric view of a second embodiment of an adaptable tube connector.
Figure 6:
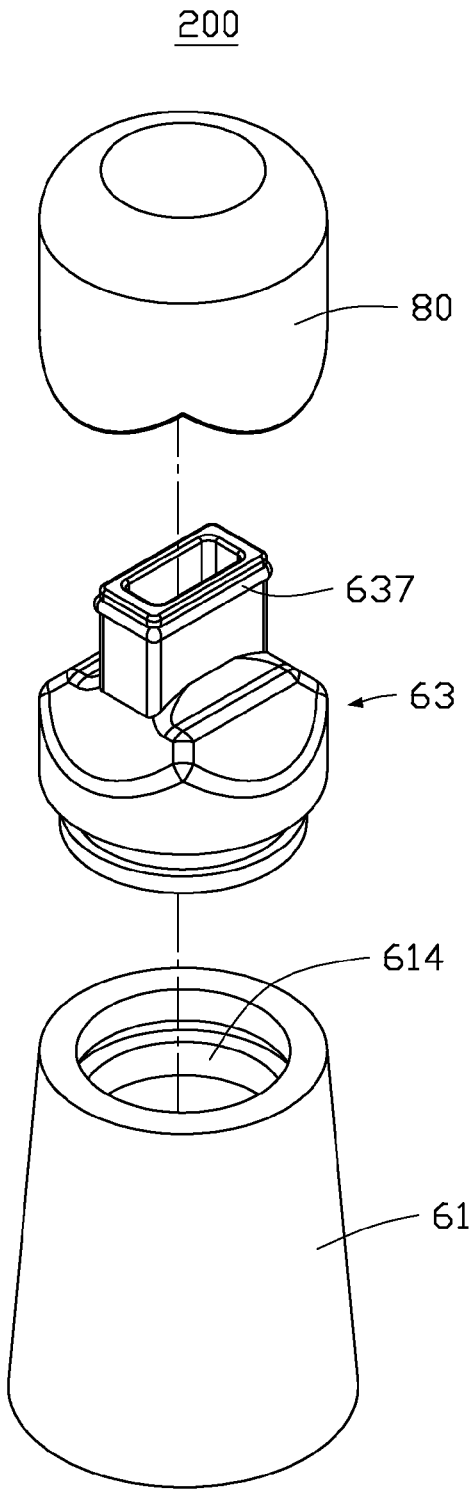
FIG. 6 is an exploded, isometric view of the adaptable tube connector of FIG. 5.
Figure 7:
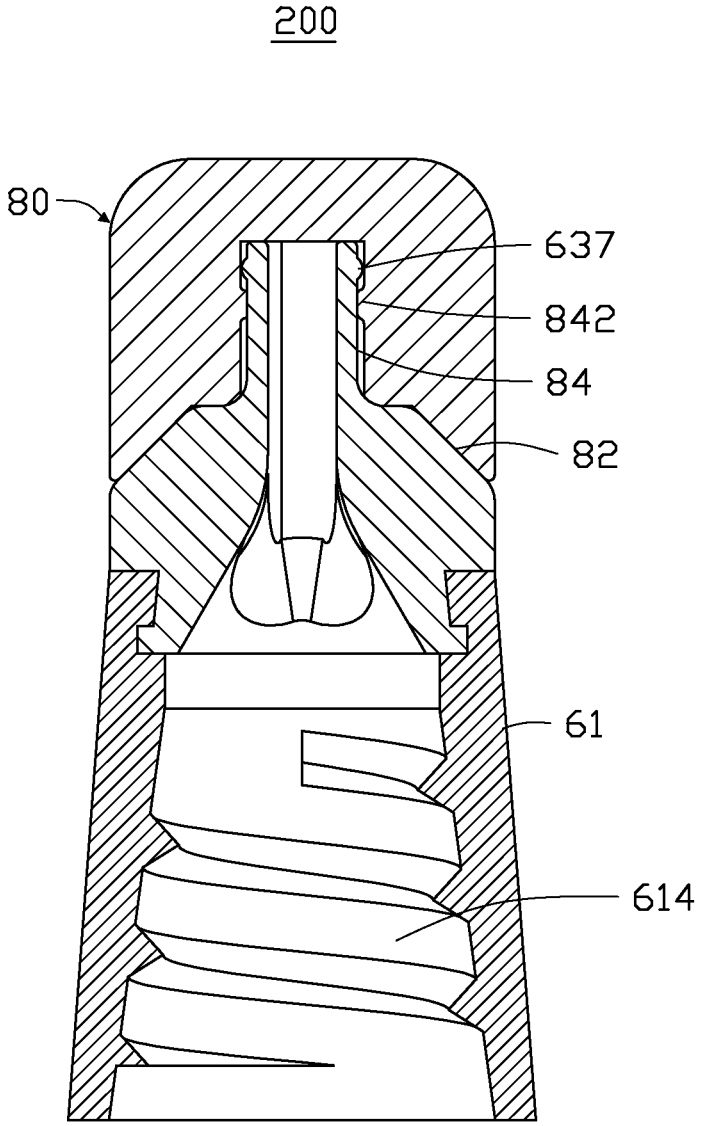
FIG. 7 is a cross-sectional view of the adaptable tube connector of FIG. 5, taken along line VII-VII of FIG. 6.

FIGS. 5 to 7 illustrate a second embodiment of the adaptable tube connector 200. The adaptable tube connector 200 can be similar to the adaptable tube connector 100, and can include the dispensing body 60 and the cap 80. The dispensing body 60 can include the connecting tube 61 and the extrusion tube 63. The connecting tube 61 can define a number of screw threads 64 on the inner surface thereof. The extrusion tube 63 can define the first latching block 637 protruding from the outer surface of the extrusion tube 63. The cap 80 can define the latching groove 82 and the receiving groove 84 from the first end to the second end. The second latching block 842 to engage with the first latching block 637 can protrude from the inner surface of the receiving groove 84. However, the connecting tube 61 can have an overall tapered shape which is different from that of the connecting tube 21, the first latching block 637 can extend around the periphery of the extrusion tube 63, and the second latching block 842 can extend around the periphery of the receiving groove 842.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure, as defined by the appended claims.

What is claimed is:

1. An adaptable tube connector configured to be coupled with a flexible tube, the adaptable tube connector comprising:

a connecting tube having an inner surface composed of flexible materials;

a plurality of radially-cut screw threads on the inner surface, each of which extends from a periphery of the connecting tube; and an extrusion tube having a first end and a second end, the first end coupled to an end of the connecting tube, communicating with the connecting tube, and having a flat outlet opening on the end thereof away from the connecting tube.

2. The adaptable tube connector of claim 1, wherein the connecting tube is cylindrical or tapered.

3. The adaptable tube connector of claim 1, wherein the connecting tube defines a latching groove on the inner surface thereof, a protrusion to be received in the latching groove protrudes from the outer surface of the extrusion tube.

4. The adaptable tube connector of claim 1, wherein extrusion tube comprises a tube body, and a connecting portion and a dispensing portion respectively coupled to opposite ends of the tube body, the connecting portion is coupled to the connecting tube, and the flat outlet opening is located on the end of the dispensing portion away from the tube body.

5. The adaptable tube connector of claim 4, wherein the tube body defines a tapered flange which on an end of the periphery of the tube body adjacent to the dispensing portion, the cap defines, in this order, a latching groove for receiving the tapered flange and a receiving groove for receiving the dispensing portion from a first end toward a second end of the cap.

6. The adaptable tube connector of claim 1, further comprising a cap covering the flat outlet opening of the extrusion tube.

7. The adaptable tube connector of claim 6, wherein a first latching block protrudes from an outer surface of the extrusion tube, and a second latching block to engage with the first latching block protrudes from the inner surface of the cap.

8. The adaptable tube connector of claim 7, wherein the first latching block is located on opposite outer surfaces of the extrusion tube or extends around the periphery of the extrusion tube, and the second latching block is located on opposite outer surfaces of the cap or extends around the periphery of the cap.

* * * * *